US009394868B2

(12) United States Patent
Soriani et al.

(10) Patent No.: US 9,394,868 B2
(45) Date of Patent: Jul. 19, 2016

(54) VALVE ASSEMBLY AND INJECTION VALVE

(75) Inventors: Matteo Soriani, Leghorn (IT); Mauro Grandi, Leghorn (IT); Valerio Polidori, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 371 days.

(21) Appl. No.: 13/522,436

(22) PCT Filed: Dec. 10, 2010

(86) PCT No.: PCT/EP2010/069399

§ 371 (c)(1),
(2), (4) Date: Jul. 16, 2012

(87) PCT Pub. No.: WO2011/085884

PCT Pub. Date: Jul. 21, 2011

(65) Prior Publication Data

US 2012/0286074 A1 Nov. 15, 2012

(30) Foreign Application Priority Data

Jan. 15, 2010 (EP) ..... 10000355

(51) Int. Cl.
*F02M 51/06* (2006.01)
*F02M 61/12* (2006.01)

(52) U.S. Cl.
CPC ..... *F02M 51/0682* (2013.01); *F02M 51/0685* (2013.01); *F02M 61/12* (2013.01)

(58) Field of Classification Search
CPC ..... B05B 1/3066; F02M 51/0675; F02M 51/0678; F02M 51/0682; F02M 51/06; F02M 61/12; F02M 51/0667; F02M 51/0685
USPC ..... 239/583–585, 533.11, 533.2, 533.3, 239/533.9, 900, 585.1
See application file for complete search history.

(56) References Cited

U.S. PATENT DOCUMENTS 4,946,132 A * 8/1990 Reiter ..... 251/129.21
6,199,776 B1 * 3/2001 Andorfer ..... 239/585.4

(Continued)

FOREIGN PATENT DOCUMENTS

CN 1360663 A 7/2002 ..... F02M 51/06
DE 102005052252 A1 * 5/2007

(Continued)

OTHER PUBLICATIONS

Chinese Office Action, Application No. 201080061399.4, 12 pages, Feb. 8, 2014.

(Continued)

*Primary Examiner* — Arthur O Hall
*Assistant Examiner* — Juan C Barrera
(74) *Attorney, Agent, or Firm* — Slayden Grubert Beard PLLC

(57) ABSTRACT

A valve assembly of an injection valve may include a valve body having a cavity forming an inner guide surface and having a fluid inlet portion and a fluid outlet portion, a valve needle in the cavity that controls a fluid flow through the fluid outlet portion, the valve needle having an upper end facing the fluid inlet portion and an inner recess extending from the upper end and enabling a fluid flow inside the valve needle. A guide element in the cavity is mechanically coupled to the upper end of the valve needle and extends radially to the inner guide surface of the valve body and guides the upper end of the valve needle inside the valve body. The guide element forms a one-piece extension of the valve needle with an inner recess hydraulically coupled to the fluid inlet portion and the inner recess of the valve needle.

11 Claims, 2 Drawing Sheets

(56) References Cited

U.S. PATENT DOCUMENTS

| | | | | |
|---|---|---|---|---|
| 7,032,846 | B1 | 4/2006 | Heyse | 239/533.2 |
| 7,717,400 | B2 * | 5/2010 | Tsuduki et al. | 251/129.21 |
| 2003/0010847 | A1 * | 1/2003 | Curran et al. | 239/585.1 |
| 2003/0136374 | A1 * | 7/2003 | Kobayashi et al. | 123/305 |
| 2004/0011897 | A1 * | 1/2004 | Dantes | F02M 51/0682 239/585.1 |
| 2005/0040258 | A1 * | 2/2005 | Dallmeyer et al. | 239/533.12 |
| 2005/0133635 | A1 * | 6/2005 | Hornby | 239/533.2 |
| 2005/0274829 | A1 * | 12/2005 | Grabandt | 239/533.2 |
| 2008/0223960 | A1 * | 9/2008 | Yamamoto et al. | 239/533.8 |
| 2009/0179166 | A1 | 7/2009 | Reiter | 251/129.15 |
| 2011/0100332 | A1 | 5/2011 | Reiter | 123/490 |

FOREIGN PATENT DOCUMENTS

| | | | | |
|---|---|---|---|---|
| DE | 102005061409 | A1 | 6/2007 | F02M 51/06 |
| DE | 102007050817 | A1 | 4/2009 | F02M 51/06 |
| DE | 102009000895 | A1 | 9/2009 | F02M 51/06 |
| EP | 2354528 | A1 | 8/2011 | F02M 51/06 |
| GB | 2323634 | A | 9/1998 | F02M 51/06 |
| WO | 2011/085884 | A1 | 7/2011 | F02M 51/06 |

OTHER PUBLICATIONS

European Search Report and Written Opinion for Application No. 10 000 355.7 (5 pages), Jul. 2, 2010.

International Search Report and Written Opinion for Application No. PCT/EP2010/069399 (9 pages), May 3, 2011.

* cited by examiner

VALVE ASSEMBLY AND INJECTION VALVE

CROSS-REFERENCE TO RELATED APPLICATIONS

This application is a U.S. National Stage Application of International Application No. PCT/EP2010/069399 filed Dec. 10, 2010, which designates the United States of America, and claims priority to EP Application No. 10000355 filed Jan. 15, 2010, the contents of which are hereby incorporated by reference in their entirety.

TECHNICAL FIELD

This disclosure relates to a valve assembly of an injection valve and an injection valve.

BACKGROUND

Injection valves are in widespread use, in particular for an internal combustion engine where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter, and all the various elements of the injection valve being responsible for the way the fluid is dosed may vary in a wide range.

In order to enhance the combustion process in view of degradation of unwanted emissions, the respective injection valve may be suited to dose fluids under high pressures. The pressures may be in the range of up to 200 bar for gasoline engines or in the range of about 2000 bar for diesel engines.

SUMMARY

In one embodiment, a valve assembly of an injection valve may include a valve body including a central longitudinal axis, the valve body having a cavity forming an inner guide surface in a guide area of the valve body, the cavity having a fluid inlet portion and a fluid outlet portion, a valve needle axially movable in the cavity, the valve needle preventing a fluid flow through the fluid outlet portion in a closing position and releasing the fluid flow through the fluid outlet portion in further positions, wherein the valve needle has an upper end facing the fluid inlet portion and an inner recess extending from the upper end toward the fluid outlet portion and enabling a fluid flow inside the valve needle, a guide element being arranged in the cavity and being mechanically coupled to the upper end of the valve needle and extending radially to the inner guide surface of the valve body and being designed to guide the upper end of the valve needle inside the valve body, wherein the guide element forms a one-piece extension of the valve needle with an inner recess being hydraulically coupled to the fluid inlet portion and to the inner recess of the valve needle.

In a further embodiment, the guide element is shaped as a cup with the inner recess and a cup opening, the cup opening facing the fluid inlet portion. In a further embodiment, the guide element and the valve needle are formed as a single deep-drawn part. In a further embodiment, the guide element has a first outer surface area being designed to guide the upper end of the valve needle inside the valve body and at least one second outer surface area having a distance from the inner guide surface of the valve body which is larger than a distance between the first outer surface area and the inner guide surface of the valve body. In a further embodiment, the at least one second outer surface area is formed as a flat portion.

In another embodiment, an injection valve includes an actuator unit and a valve assembly having any of the features disclosed above, wherein the actuator unit comprises an armature which is arranged in the cavity and is moveable relative to the valve needle and is designed to mechanically cooperate with the guide element.

BRIEF DESCRIPTION OF THE DRAWINGS

Example embodiments will be explained in more detail below with reference to figures, in which.

DETAILED DESCRIPTION

Figure 1:
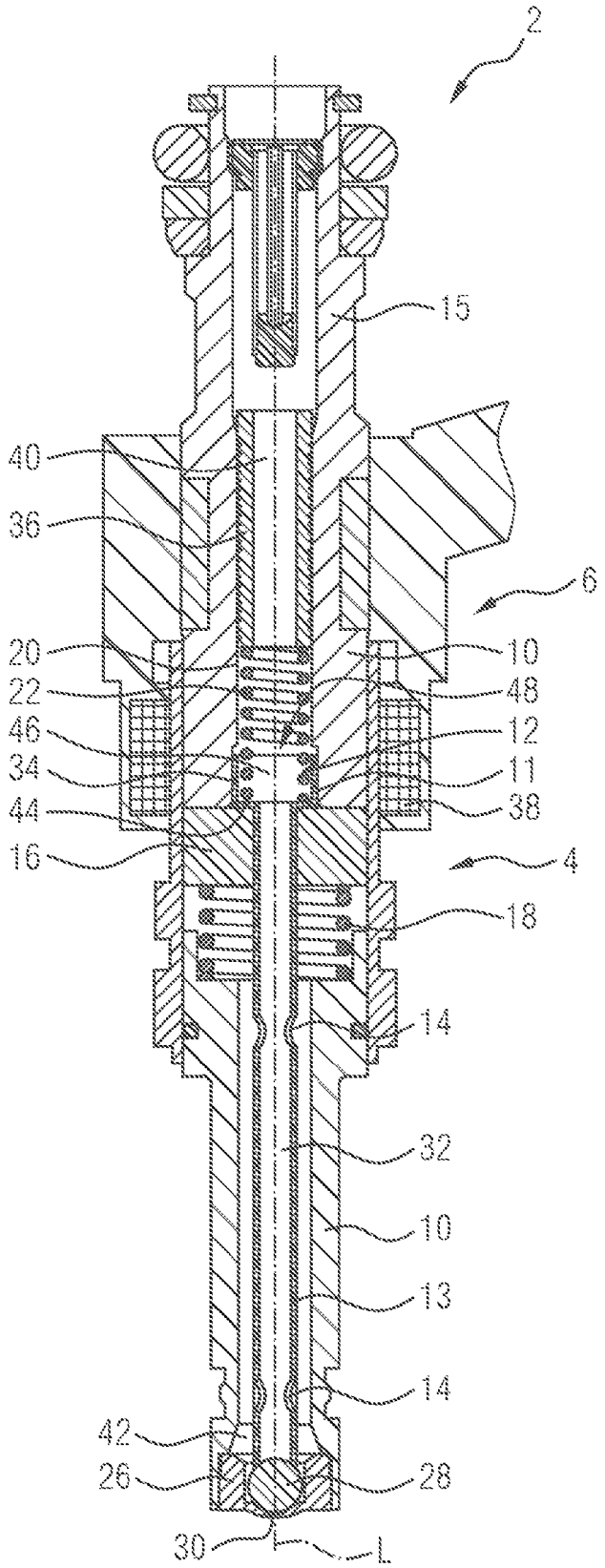
FIG. 1 shows an example injection valve in a longitudinal section view, according to one embodiment.
Figure 2:
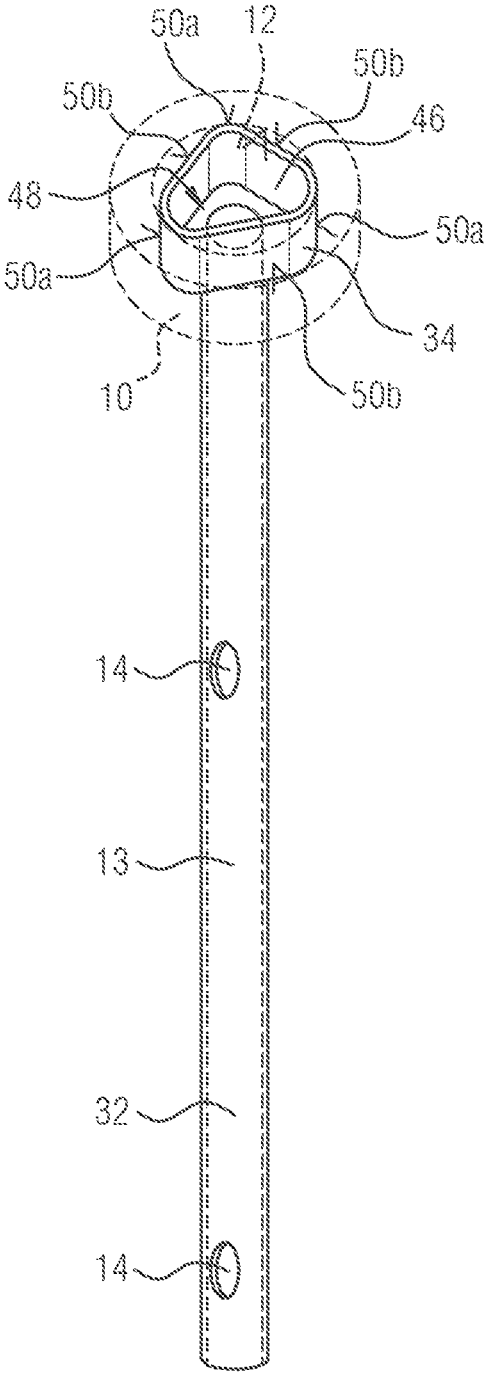
FIG. 2 shows an enlarged view of an embodiment of a valve assembly in a perspective view.
Figure 3:
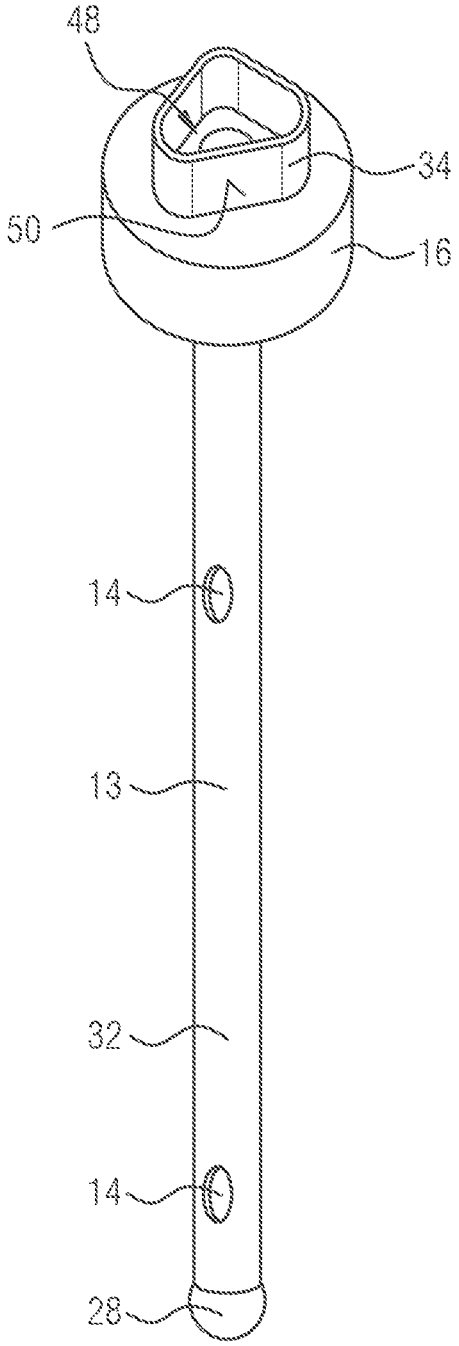
FIG. 3 shows an enlarged view of an embodiment of the valve assembly in a perspective view.

Some embodiments provide a valve assembly of an injection valve and an injection valve which are simply to be manufactured and which facilitate a reliable and precise function.

One embodiment provides a valve assembly of an injection valve. The valve assembly comprises a valve body including a central longitudinal axis. The valve body has a cavity forming an inner guide surface in a guide area of the valve body, the cavity having a fluid inlet portion and a fluid outlet portion. The valve assembly comprises a valve needle axially movable in the cavity. The valve needle prevents a fluid flow through the fluid outlet portion in a closing position and releases the fluid flow through the fluid outlet portion in further positions. The valve needle has an upper end facing the fluid inlet portion and an inner recess extending from the upper end in direction to the fluid outlet portion and enabling a fluid flow inside the valve needle. The valve assembly comprises a guide element being arranged in the cavity and being mechanically coupled to the upper end of the valve needle and extending radially to the inner guide surface of the valve body and being designed to guide the upper end of the valve needle inside the valve body. The guide element forms a one-piece extension of the valve needle with an inner recess which is hydraulically coupled to the fluid inlet portion and to the inner recess of the valve needle.

This may provide that a direct fluid flow from the fluid inlet portion to the inner recess of the guide element and to the inner recess of the valve needle can be obtained. Furthermore, there is no need to couple the valve needle with the guide element in a separate process step. Furthermore, a good alignment of the valve needle relative to the valve body and a good guidance of the valve needle in the valve body can be obtained. This can result in an excellent dynamic performance of the injection valve. Consequently, a high life-time of the valve assembly is possible. Furthermore, the integral formation of the guide element with the valve needle allows to achieve a low cost solution for the valve assembly.

In one embodiment, the guide element is shaped as a cup with the inner recess and a cup opening. The cup opening faces the fluid inlet portion. This may provide an excellent fluid flow from the fluid inlet portion via the cup opening to the inner recess of the valve needle.

In another embodiment, the guide element and the valve needle are formed as a single deep-drawn part. This may provide for a low cost solution for the valve assembly.

In another embodiment, the guide element has a first outer surface area being designed to guide the upper end of the valve needle inside the valve body and at least one second outer surface area. The second outer surface area has a distance from the inner guide surface of the valve body which is larger than a distance between the first outer surface area and the inner guide surface of the valve body. Thus, the valve needle can be guided very well and an excellent dynamic behavior of the valve needle due to fluid channels formed between the guide element and the inner guide surface of the valve body can be obtained.

In another embodiment, the at least one second outer surface area is formed as a flat portion. Flat portions can be manufactured very easily.

Other embodiments provide an injection valve with an actuator unit and a valve assembly as discussed above. The actuator unit comprises an armature. The armature is arranged in the cavity and is moveable relative to the valve needle and is designed to mechanically cooperate with the guide element.

An injection valve 2 (FIG. 1) that is in particular suitable for dosing fuel to an internal combustion engine comprises a valve assembly 4 and an actuator unit 6.

The valve assembly 4 comprises a valve body 10 with a central longitudinal axis L and a cavity 11. In a guide area of the valve body 10 the cavity 11 forms an inner guide surface 12 for a valve needle 13 which is arranged in the cavity 11. The valve needle 13 can be moved in the cavity 11 in axial direction. The valve needle 13 is hollow with an inner recess 32. The valve needle 13 has orifices 14 which enable a fluid flow between the inner recess 32 and the outside of the valve needle 13.

The valve body 10 further comprises an inlet tube 15. The inner guide surface 12 is arranged in the inlet tube 15.

The actuator unit 6 has an armature 16 which is arranged in the cavity 11. A recess is provided in the armature 16 which takes up a part of the valve needle 13. The armature 16 can move relative to the valve needle 13. In the cavity 11 an armature spring 18 is arranged and is coupled to the armature 16 to exert a force on the armature 16 in axial direction.

A recess 20 is provided in the inlet tube 15. A main spring 22 is arranged in the recess 20 of the inlet tube 15. The main spring 22 is mechanically coupled to the valve needle 13 to exert a force on the valve needle 13 in axial direction.

The valve needle 10 comprises a seat part 28 which has a spherical shape. In the closing position of the valve needle 13 the seat part 28 rests on a seat body 26 being part of the valve body 10. In this case a fluid flow through at least one injection nozzle 30 is prevented. The injection nozzle 30 may be an injection hole for example.

A guide element 34 is arranged in the cavity 11. The guide element 34 extends from the valve needle 13 to the inner guide surface 12 of the valve body 10. The guide element 34 is provided for guiding the valve needle 13 inside the valve body 10. The guide element 34 is formed integrally with the valve needle 13. Therefore, no further process steps for a coupling of the guide element 34 with the valve needle 13 as for example press fitting or welding are necessary. The guide element 34 and the armature 16 are forming an interlocking device so that the armature 16 entrains the guide element 34 for an axial movement of the valve needle 13.

The main spring 22 rests on a first spring seat being formed by the surface of the guide element 34 and a second spring seat being formed by a tube 36 which is provided in the recess 20 of the inlet tube 15.

The actuator unit 6 may comprise an electromagnetic actuator with a coil 38. The coil 38, the armature 16 and the inlet tube 15 are forming an electromagnetic circuit.

The valve assembly 4 has a fluid inlet portion 40 which is provided in the valve body 10. In particular, the fluid inlet portion 40 is provided in the inlet tube 15. Furthermore, the valve assembly 4 has a fluid outlet portion 42 which is provided in the valve body 10 near the seat body 26. The fluid inlet portion 40 is in hydraulic communication with the fluid outlet portion 42 via the orifices 14.

The valve needle 13 has an upper end 44 facing the fluid inlet portion 40. The inner recess 32 of the valve needle 13 extends from the upper end 44 in direction to the fluid outlet portion 42. Fluid may flow through the inner recess 32 inside the valve needle 13 to the orifices 14.

The guide element 34 is coupled to the upper end 44 of the valve needle 13 and extends radially to the inner guide surface 12 of the valve body 10. The guide element 34 is cup-shaped and has an inner recess 46 which is hydraulically coupled to the fluid inlet portion 40 via a cup opening 48 of the guide element 34. Furthermore, the inner recess 46 is hydraulically coupled to the inner recess 32 of the valve needle 13. A primary fluid flow passes from the fluid inlet portion 40 to the cup opening 48 and the inner recess 46 of the guide element 34 and further to the inner recess 32 of the valve needle 13. The guide element 34 and the valve needle 13 may be formed as a single deep-drawn part which can be produced easily and with low costs.

The guide element 34 has a first outer surface area 50*a*. The first outer surface area 50*a* has a very small distance from the inner guide surface 12 of the valve body 10. Therefore, the guide element 34 can guide the upper end 44 of the valve needle 13 inside the valve body 10. The guide element 34 has at least one second outer surface area 50*b*. The second outer surface area 50*b* is formed as a flat portion. The second outer surface area 50*b* has a distance from the inner guide surface 12 of the valve body 10 which is larger than the distance between the first outer surface area 50*a* and the inner guide surface 12 of the valve body 10. Therefore, between the second outer surface area 50*b* and the inner guide surface 12 of the valve body 10 a channel is formed which enables a fluid flow on a secondary flow passage.

In the following, the function of the injection valve is described in detail:

The fluid is led from the fluid inlet portion 40 to the inner recesses 32, 46 of the guide element 34 and the hollow valve needle 13 and then through the orifices 14 to the fluid outlet portion 42. The main spring 22 forces the valve needle 13 in an axial direction towards the seat body 26. It is depending on the force balance between the force on the valve needle 13 caused by the actuator unit 6 and the force on the valve needle 13 caused by the main spring 22 whether the valve needle 13 is in its closing position or not.

When the actuator unit 6 is de-energized, the main spring 22 can exert a force on the guide element 34 and the valve needle 13 in a manner that the valve needle 13 can move in axial direction in its closing position, and the seat part 28 is forced to sealingly rest on the seat body 26. The armature spring 18 dampens the movement of the armature 16. Furthermore, due to the flat surface areas 50*b* of the guide element 34 a sticking effect between the armature 16 and the inlet tube 15 can be prevented. Consequently, the movement of the valve needle 13 in axial direction towards the seat body 26 can be dampened. In the closing position of the valve needle 13 a fluid flow through the fluid outlet portion 42 and the injection nozzle 30 is prevented.

If the actuator unit 6 is energized, the actuator unit 6, in particular the armature 16, may exert a force on the guide element 34 which is transmitted directly to the valve needle 13. The force from the armature 16 on the guide element 34 is contrary to the force on the valve needle 13 caused by the main spring 22. Thus, the valve needle 13 is able to move in an axial direction out of the closing position. The movement of the armature 16 is limited when the armature 16 gets into contact with inlet tube 15. Outside of the closing position of the valve needle 13, there is a gap between the seat body 26 and the seat part 28 of the valve needle 13. This gap enables a fluid flow through the injection nozzle 30.

In general, a good dynamic performance of the injection valve during the opening and the closing process can be obtained due to the guide element 34 being in one part with the valve needle 13. Consequently, a high reliability and a long life-time of the valve assembly 4 and the injection valve 2 are possible. Furthermore, the valve needle 13 being in one part with the guide element 34 can be easily produced and results in a low number of components of the valve assembly 4. Therefore, it is possible to obtain a low cost solution for the valve assembly 4 and the injection valve 2.

What is claimed is:

1. A valve assembly for an injection valve having an actuator unit with an armature having an outer circumference, the valve assembly comprising: a valve body including a central longitudinal axis, the valve body having a cavity forming an inner guide surface in a guide area of the valve body, the cavity having a fluid inlet portion and a fluid outlet portion, a valve needle axially movable in the cavity, the valve needle preventing a fluid flow through the fluid outlet portion in a closing position and releasing the fluid flow through the fluid outlet portion in further positions, wherein the valve needle has an upper end extending into the fluid inlet portion of the valve body, the valve needle having an inner recess extending from the upper end in a direction toward the fluid outlet portion and enabling a fluid flow inside the valve needle, the valve needle upper end includes a guide portion extending radially to the inner guide surface inside the guide area of the valve body, the guide portion of the valve needle and the guide area inside the valve body each having a circumference less than the outer circumference of the armature of the actuator unit, wherein the guide portion comprises a non-cylindrical outer radial perimeter defined at least in part by at least one first radially outward surface guided by the inner guide surface of the valve body to guide the upper end of the valve needle inside valve body, at least one second radially outward surface comprising at least one flat surface extending parallel to the longitudinal axis of the valve body, and a guide portion inner recess hydraulically coupled to the fluid inlet portion of the valve body and to the valve needle inner recess.

2. The valve assembly of claim 1, wherein the guide portion is shaped as a cup including the guide portion inner recess and a cup opening, the cup opening facing the fluid inlet portion.

3. The valve assembly of claim 1, wherein the guide portion and the valve needle are formed as a single deep-drawn part.

4. An injection valve comprising:

an actuator unit, and a valve assembly comprising:

a valve body including a central longitudinal axis, the valve body having a cavity forming an inner guide surface in a guide area of the valve body, the cavity having a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle having an upper end extending into the guide area of the fluid inlet portion and a valve needle inner recess extending from the upper end in a direction toward the fluid outlet portion and enabling a fluid flow inside the valve needle, the upper end of the valve needle includes a guide portion extending radially to the inner guide surface inside of the guide area of the valve body, the guide portion configured to guide the upper end of the valve needle inside the guide area of the valve body, the guide portion comprising a non-cylindrical outer radial perimeter defined at least in part by at least one first radially outward surface guided by the inner guide surface of the valve body to guide the upper end of the valve needle inside the valve body, and at least one second radially outward surface comprising at least one flat surface extending parallel to the longitudinal axis of the valve body, and includes a guide portion inner recess hydraulically coupled to the fluid inlet portion of the valve body and to the valve needle inner recess, wherein the actuator unit comprises an armature having an outer circumference, the armature arranged in the cavity and moveable relative to the valve needle, the armature mechanically cooperates with the guide portion of the valve needle, and the guide portion of the valve needle and the guide area of the valve body each having a circumference less than the outer circumference of the armature.

5. The injection valve of claim 4, wherein the guide portion is shaped as a cup including the guide portion inner recess and a cup opening, the cup opening facing the fluid inlet portion.

6. The injection valve of claim 4, wherein the guide portion and the valve needle are formed as a single deep-drawn part.

7. The valve assembly of claim 4, wherein a plane extending through and perpendicular to a particular point along the central longitudinal axis passes through both the first and second radially outward surfaces of the guide portion.

8. A valve needle for an injection valve having a body, the valve needle comprising:

upper and lower ends, the upper end for extending into an inner guide surface of the injector valve body, an inner recess extending from the upper end enabling a fluid flow inside the valve needle, the upper end of the valve needle including a guide portion, the guide portion sized to fit into an inner guide surface of the injector valve body, the guide portion including a guide portion inner recess for hydraulically coupling to a fluid inlet portion of the injector valve body and to the valve needle inner recess, wherein the guide portion comprises a non-cylindrical outer radial perimeter defined at least in part by at least one first radially outward surface to be guided by the inner guide surface of the valve body to guide the upper end of the valve needle inside valve body, and at least one second radially outward surface comprising at least one flat surface extending parallel to the longitudinal axis of the valve body.

9. The valve needle of claim 8, wherein the guide portion and the valve needle are formed as a single deep-drawn part.

10. The valve needle of claim 9, wherein the guide portion is shaped as a cup including the guide portion inner recess and a cup opening, the cup opening for facing the fluid inlet portion of the injector valve body.

11. The valve needle of claim 10, wherein the at least one second radially outward surface comprises at least one flat surface extending parallel to the longitudinal axis of the injector valve body.

* * * * *